US011517960B2

(12) United States Patent
Youssef et al.

(10) Patent No.: US 11,517,960 B2
(45) Date of Patent: Dec. 6, 2022

(54) METHOD FOR PRODUCING A COMPONENT

(71) Applicant: Ford Global Technologies, LLC, Dearborn, MI (US)

(72) Inventors: Mohamed Youssef, Aachen (DE); Matthias Warkentin, Jülich (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/031,160

(22) Filed: Sep. 24, 2020

(65) Prior Publication Data

US 2021/0086258 A1 Mar. 25, 2021

(30) Foreign Application Priority Data

Sep. 24, 2019 (DE) ..... 102019125679.8

(51) Int. Cl.

| | |
|---|---|
| ***B22D 21/00*** | (2006.01) |
| ***B22D 21/04*** | (2006.01) |
| ***B22D 17/00*** | (2006.01) |
| ***C22C 21/08*** | (2006.01) |

(52) U.S. Cl.

CPC ..... *B22D 21/007* (2013.01); *B22D 17/007* (2013.01); *C22C 21/08* (2013.01)

(58) Field of Classification Search

CPC ..... B22D 17/00; B22D 17/007; B22D 17/08; B22D 17/12; B22D 17/2023; B22D 21/00; B22D 21/04; B22D 21/007; C22C 1/005; C22C 21/06; C22C 21/08

USPC ..... 164/80, 113, 900

See application file for complete search history.

(56) References Cited

U.S. PATENT DOCUMENTS

| | | | |
|---|---|---|---|
| 5,115,770 | A | 5/1992 | Ten et al. |
| 6,773,664 | B2 * | 8/2004 | Spanjers et al. ..... C22C 21/06 420/541 |
| 9,715,971 | B2 | 7/2017 | Suzuki et al. |
| 9,920,401 | B2 | 3/2018 | Seo et al. |
| 2003/0178106 | A1 | 9/2003 | Dasgupta |
| 2013/0269842 | A1 | 10/2013 | Seki et al. |
| 2018/0274073 | A1 | 9/2018 | Mann et al. |

FOREIGN PATENT DOCUMENTS

| | | |
|---|---|---|
| CN | 108165842 | 6/2018 |

* cited by examiner

*Primary Examiner* — Kevin P Kerns
(74) *Attorney, Agent, or Firm* — Burris Law, PLLC

(57) ABSTRACT

A method for producing a component from an aluminum alloy using a semisolid method is provided. The alloy contains less than 1.3% by weight of iron and no more than 0.2% by weight of silicon, and the component has sufficient ductility such that the component can be joined to other components by self-piercing riveting, flow drilling, high-speed tack setting, friction welding and/or weld riveting.

20 Claims, 6 Drawing Sheets

METHOD FOR PRODUCING A COMPONENT

CROSS-REFERENCE TO RELATED APPLICATIONS

This application claims priority to and the benefit of German Application No. 102019125679.8 filed on Sep. 24, 2019. The disclosures of the above applications are incorporated herein by reference.

FIELD

The present disclosure relates to a method for producing a component, and particularly to an alloy based on aluminum to produce a component.

BACKGROUND

The statements in this section merely provide background information related to the present disclosure and may not constitute prior art.

Components made of aluminum or aluminum alloys are used in various sectors, especially also in the construction of motor vehicles. In comparison with steel components, there is the advantage not only of higher corrosion resistance but also especially of lower density. The latter allows minimization of weight, even if there is a need in some cases for greater material thicknesses to achieve desired material properties. To produce aluminum components (which in this context include components made of aluminum alloys), various methods can be employed. Apart from primary forming, this includes both hot forming and cold forming. Whereas the metal is in a liquid state in the case of primary forming methods, e.g. the diecasting of aluminum, and in a solid state in the case of traditional forming methods, the temperature set in "semisolid" methods is one at which the metal is partially liquid and partially solid. In the region of the transition temperature between solid and liquid, the thixotropic state is achieved, in which finely distributed crystallized components are embedded in molten regions. In this thixotropic state, the viscosity of the material decreases under the action of shear forces, thereby enabling it to be forced into virtually any mold in a precise way at a relatively low pressure, for example. In particular, it is possible to produce very thin-walled components in comparison with conventional diecasting. In semisolid methods, the aim is to obtain an optimum volume percentage of liquid phase, which allows low friction forming of the remaining, still-solid alloy components by forging, casting, continuous extrusion and power-press extrusion etc. of the metallic material in the thixotropic state.

At the same time, not all aluminum alloys that are suitable, for example, for conventional diecasting are also suitable for semisolid methods. This applies especially to many silicon-free alloys known in the prior art, e.g. Castaduct®-42 (AlMg4Fe2). The latter material is suitable for diecasting and is distinguished in the solid state by advantageous mechanical properties, particularly high ductility. In the region of the transition temperature, which would have to be set for semisolid methods, an Al13Fe4 phase forms, however, while no Al phase is obtained. To carry out a semisolid method, however, the formation of an Al phase embedded in liquid material is desired. In the prior art, this can be achieved with aluminum alloys which have a considerable proportion of silicon, e.g. between 5 and 10% by weight (with the terms "percent by weight" and "percent by mass" being used synonymously here and below). However, such alloys generally have a significantly reduced ductility and are therefore unsuitable for certain applications.

U.S. Pat. No. 9,920,401 B2 discloses an aluminum alloy with a high thermal conductivity, which is provided for diecasting. Apart from aluminum, the alloy contains 0.2-2.0% by weight of magnesium, 0.1-0.3% by weight of iron and 0.1-1.0% by weight of cobalt. It is provided particularly for the production of LED components.

U.S. Pat. No. 9,715,971 B2 discloses an electrode for a secondary battery which has a film composed of an aluminum alloy. The aluminum alloy contains 0.03-0.1% by weight of iron, up to 0.1% by weight of silicon, and optionally titanium and copper. First of all, a billet is produced from the alloy by continuous or semicontinuous extrusion and thermally homogenized, and is then rolled out to produce the film. US 2013/0269842 A1 relates to a similar electrode, although in this case the aluminum alloy contains 0.03-0.1% by weight of iron, 0.01-0.1% by weight of silicon and small quantities of copper.

US 2018/0274073 A1 discloses a high-strength aluminum alloy which, in addition to aluminum, contains 0.3-1.0% by weight of iron as well as zinc, magnesium, nickel, copper, zirconium, titanium, scandium and chromium. Here, it is envisaged that iron and nickel form aluminides of an Al9FeNi phase, which accounts for at least 2% by volume. From the aluminum alloy it is possible to cast or forge components.

CN 108165842 A discloses an aluminum alloy which is suitable particularly for semisolid methods. Apart from aluminum, the alloy contains 6.6-7.4% by weight of silicon, no more than 0.15% by weight of iron, 0.15-0.25% by weight of magnesium, as well as titanium, chromium, ytterbium, tellurium, beryllium and possibly traces of other elements.

US 2003/0178106 A1 discloses an aluminum alloy containing 6.5-8.5% by weight of silicon, 0.6-1.0% by weight of iron, as well as manganese, magnesium, zinc, titanium, copper and up to 0.15% by weight of other elements. The alloy is provided particularly for semisolid methods.

U.S. Pat. No. 5,115,770 A relates to an aluminum alloy which contains up to 0.8% by weight of iron, up to 0.6% by weight of silicon, as well as copper, manganese, vanadium, zirconium and, optionally, small quantities of zinc, manganese and nickel. By diecasting, it is possible to produce from the alloy components which have a particular tensile strength, even if they are exposed to an elevated temperature for prolonged periods of time, e.g. a piston for an internal combustion engine.

SUMMARY

This section provides a general summary of the disclosure and is not a comprehensive disclosure of its full scope or all of its features.

In one form of the present disclosure, production of components of enhanced ductility from an aluminum alloy by means of a semisolid method is provided.

It should be noted that features and measures presented individually in the following description can be combined in any technically worthwhile way and give rise to further forms or variations taught in the present disclosure. The description additionally characterizes and specifies the present disclosure, more particularly in conjunction with the figures.

In at least one form of the present disclosure, a method for producing a component is provided. In this context, the term "component" should be interpreted broadly and, in addition to fully finished parts that do not require any further processing, also refers to parts which may be subject to further processing, e.g. machining, surface treatment, surface coating or the like, before being used. In particular, the term in this context also includes semifinished products.

In the method, an alloy based on aluminum is prepared and converted to a semisolid state, and the component is produced therefrom by a semisolid method. In this context, the alloy based on aluminum—the term "aluminum alloy" could also be used—preferably contains at least 70% by weight, for example at least 80% by weight, or at least 90% by weight, of aluminum. Apart from aluminum, the alloy contains at least one further element. In particular, the at least one further element can be a metal but optionally also a semi-metal and/or a nonmetal. The alloy is prepared—one could also say produced—and converted to a semisolid state. This state, which may also be referred to as a thixotropic state, is characterized by the fact that portions of the alloy are solid, while other portions are liquid. Usually, the semisolid state is achieved by first of all melting the alloy or melting individual components of the alloy and then mixing them to form the alloy, after which the alloy is cooled until the semisolid state is achieved in the region of the transition temperature. During this process, the alloy can be held in a container which has a heater or cooler for heating or cooling the container, and by which the temperature of the alloy and thus the semisolid state can be stabilized at least temporarily. Moreover, mixing the alloy can be provided, e.g., mixing of the alloy at least in the liquid state, optionally also in the semisolid state. Mixing can be accomplished, for example, by electromagnetic fields, by ultrasound or by an enthalpy exchanger. After the alloy has been converted to the semisolid state, the component is produced from the alloy by a semisolid method. In this context, the term "semisolid method" refers in general to a shaping method in which shaping takes place while the alloy is in a semisolid state. Here, a semisolid method is in general characterized as a primary forming method.

According to one form of the present disclosure, the alloy contains less than 1.3% by weight of iron and no more than 0.2% by weight of silicon. Owing to the low silicon content, which may also be negligible in the context of the present disclosure, the alloy may also be regarded as (almost) free of silicon. This is in contrast to aluminum alloys which are used for semisolid methods in the prior art and have considerable proportions of silicon, e.g. in the range of 5-10% by weight. While such alloys are good for use in semisolid methods, the components manufactured therefrom have a relatively low ductility or low elongation at break (even if this can be raised by heat treatment). By virtue of the fact that, according to the present disclosure, the proportion of iron by weight is limited to less than 1.3%, it is possible to prevent the formation of an Al13Fe4 phase even before a pure aluminum phase is present. According to the present disclosure, it is possible to achieve a semisolid state in which solid aluminum particles are contained in an otherwise liquid phase or suspended therein. The low proportion by weight of iron according to the present disclosure also has the effect that, after the cooling and hardening of the alloy, there is a lower proportion of Al13Fe4 phase, which has an advantageous effect on the ductility or elongation at fracture of the finished component. It has been found that it is possible, by reducing the proportion of iron to less than 1.3% by weight, to increase the temperature range in which the alloy is in the semisolid state. Process control is thereby significantly simplified.

In principle, the method according to the present disclosure can belong to different categories, e.g. thixotropic welding, wherein shaping takes place between two dies which are moved toward one another. In some variations the component produced by rheocasting where the alloy is introduced in a semisolid state, via at least one transfer opening, into a predominantly closed mold cavity and solidifies in the mold cavity. Here, the mold cavity is a hollow space which is formed within a mold. In this case, the mold can be formed, for example, by two mold halves, which are joined together to form the mold cavity before the alloy is introduced. Said cavity is predominantly closed but has at least one transfer opening for the introduction of the alloy. It is also possible for the alloy to be introduced simultaneously or successively into the mold cavity through a plurality of transfer openings. In particular, it can be forced or injected under pressure into the mold cavity. As described above, the alloy can initially be held in a liquid state in a container, which can optionally be cooled and/or heated. Once the semisolid state has been established, the alloy can be delivered from the container into the mold cavity through the at least one transfer opening by a pressure piston or a feed screw, for example.

In some variations, the alloy contains no more than 0.1% by weight, e.g., no more than 0.05% by weight of silicon. In at least one variation, the proportion of silicon can be reduced even further, e.g. to no more than 0.01% by weight or no more than 0.001% by weight, and therefore the alloy may be regarded as substantially free of silicon. In some variations, the proportion of silicon is reduced to unavoidable contamination.

According to one form of the present disclosure, the proportion of iron can be even further reduced, with the result that the alloy contains no more than 1.0% by weight of iron. It has been found here that the temperature range in which the semisolid state can be stabilized becomes larger with a decreasing proportion of iron. Under some circumstances, the proportion of iron may also be no more than 0.7% by weight or no more than 0.5% by weight.

Even if the reduction in the proportion of iron has the positive effects described above, it is unnecessary to reduce the proportion of iron "to zero". To set certain alloy properties, a certain non-negligible proportion of iron may be advantageous. Moreover, it has been found that wear within the casting mold is lower with than without a proportion of iron. Under this aspect, in some variations the alloy contains at least 0.1% by weight of iron. In at least one variation the alloy contains at least 0.3% by weight of iron.

In some variations, the alloy can contain magnesium. This may also be contained in combination with iron, and therefore it is possible to refer to an aluminum-magnesium-iron alloy. In the finished component, the magnesium may then be present within an Al3Mg2 phase.

The proportion of magnesium by weight can vary but is normally no more than 10% by weight. In some variations, the alloy contains 3.0-4.6% by weight of magnesium. Non-limiting examples of the lower limit for the proportion of magnesium can be 3.2% by weight, 3.4% by weight or 3.6% by weight. Also, non-limiting examples of the upper limit for the proportion of magnesium can be 4.5% by weight or 4.4% by weight.

In some variations, the alloy contains no more than 1.0% by weight of additional elements which differ from aluminum, magnesium, iron and silicon. In at least one variation, the proportion of these elements is below 0.5% by weight. Such optionally contained additional elements could be metals, for example, copper, manganese, zinc, molybdenum, zirconium, beryllium and/or titanium. In some variations, the additional elements can contain copper in a proportion by weight of no more than 0.2% by weight and manganese in a proportion by weight of no more than 0.1% by weight, and the total proportion by weight of any other elements (apart from Al, Mg, Fe, Si, Cu and Mn) is below 0.05% by weight.

In one form of the present disclosure, the method according to the present disclosure produces a component for a motor vehicle. The component can be provided for the chassis or the body. In this context, the components concerned are any for which the semisolid method or rheocasting has advantages over other methods, e.g. diecasting, because, for example, particularly thin-walled components are to be produced, and for which enhanced ductility is an advantage. These include paneling elements, support elements, suspension components, engine components or other components. The method is furthermore suitable for producing a component which is subsequently to be connected to a second component by self-piercing riveting (SPR). The second component can be composed, for example, of steel. In this connection method, the enhanced ductility established according to the present disclosure is advantageous. Other connection methods in which this ductility has an advantageous effect are screw-joining by flow drilling, high-speed tack setting, friction welding and weld riveting.

The present disclosure also relates to the use of an alloy based on aluminum to produce a component by a semisolid method, for example by rheocasting, wherein the alloy contains less than 1.3% by weight of iron and no more than 0.2% by weight of silicon. The terms mentioned have already been explained with reference to the method according to the present disclosure and are thus not explained again. Claimed forms or variations of the use according to the present disclosure correspond to those of the method according to the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
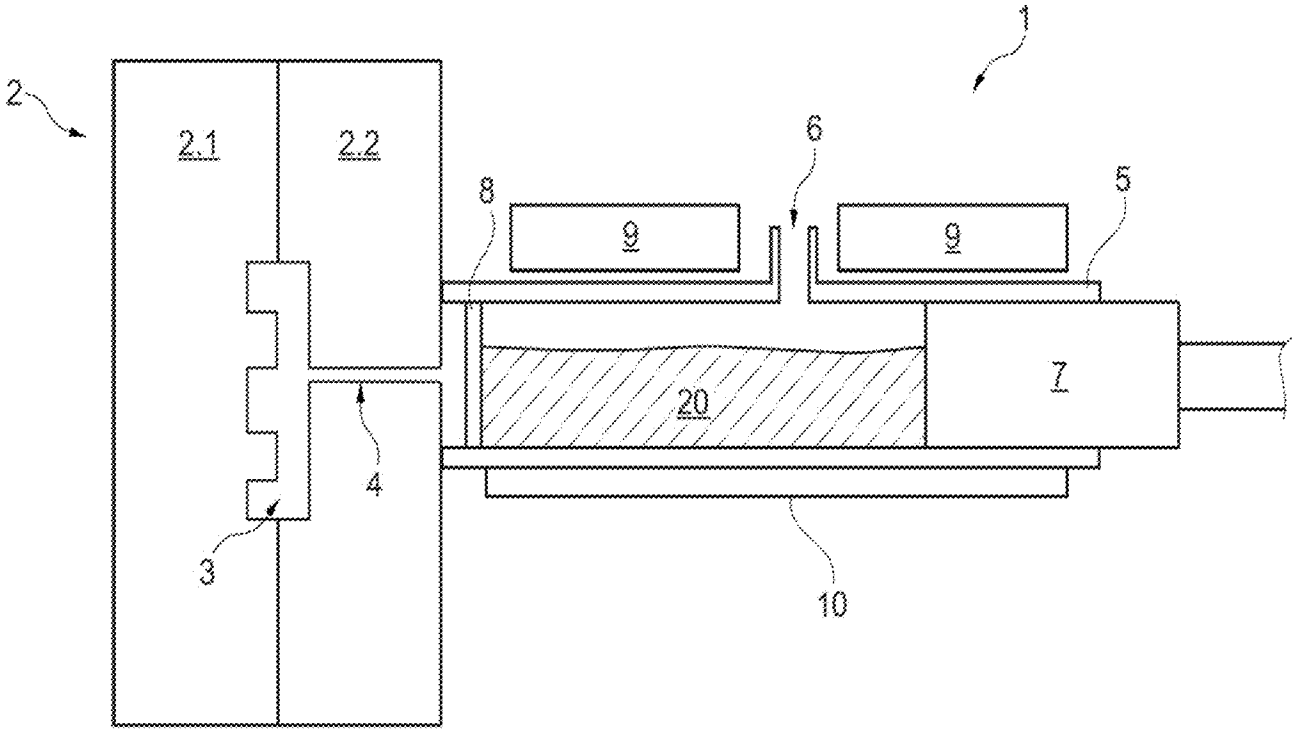
FIG. 1 shows a schematic illustration of a first stage of a method according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the various figures, identical parts are in all cases provided with the same reference signs, for which reason said parts are generally also described only once.

FIG. 1 shows a device 1 for carrying out a method according to the teachings of the present disclosure. Here, the intention is to produce a component by rheocasting from an alloy 20 based on aluminum. As can be seen, a mold 2 having a first mold half 2.1 and a second mold half 2.2, which, when joined together, define between them a mold cavity 3. On one side, the mold cavity 3 is connected to a transfer opening 4, which, in turn, is connected to a container 5. The container 5 has a filling opening 6, through which the alloy 20 can be introduced in liquid form. Within the container 5, the alloy 20 is converted to a semisolid state, wherein the desired temperature of the alloy 20 is established by a temperature control device 10, which can both cool and heat. Arranged adjoining the container 5 there is furthermore a mixing device 9, which can be designed, for example, to produce electromagnetic fields. These act on the alloy 20 and bring about improved mixing of the individual components, at least in the liquid state of said alloy. Arranged within the container 5 there is, on the one hand, a movable piston 7 and, on the other hand, a transfer hatch 8. The alloy 20 is initially enclosed between the piston 7 and the transfer hatch 8 (see FIG. 1).

Figure 2:
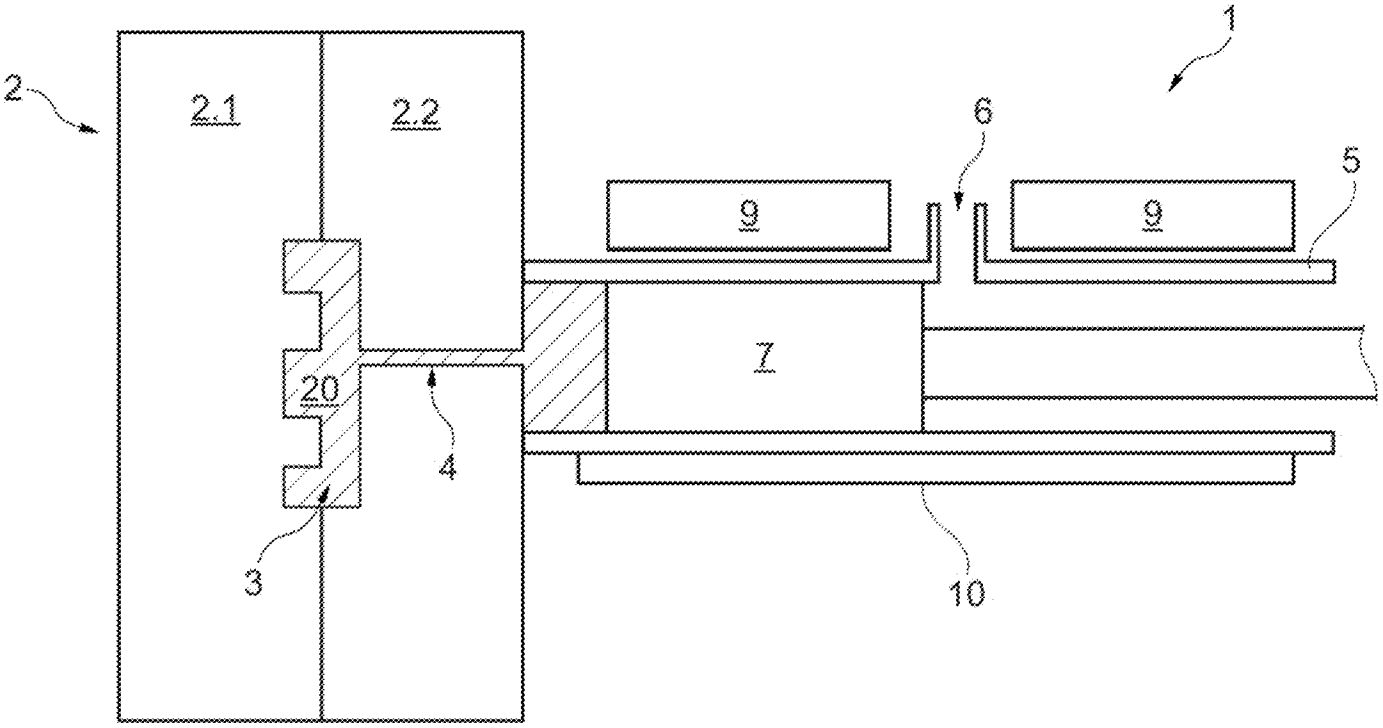
FIG. 2 shows a schematic illustration of a second stage of the method according to the teachings of the present disclosure.

When the alloy 20 has been converted to the semisolid state, the actual shaping process begins, for which purpose the transfer hatch 8 is opened (see FIG. 2), while the piston 7 is moved in the direction of the mold 2. The alloy 20 is thereby moved through the container 5 and forced onward, via the transfer opening 4, into the mold cavity 3, while it continues in the semisolid state. Within the mold cavity 3, the alloy 20 hardens and forms the desired component.

The component produced could be, in particular, a body component which is subsequently connected by self-piercing riveting (SPR) to another component, which is made of steel, for example. In this method, the enhanced ductility which is established according to the teachings of the present disclosure is advantageous.

Figure 3:
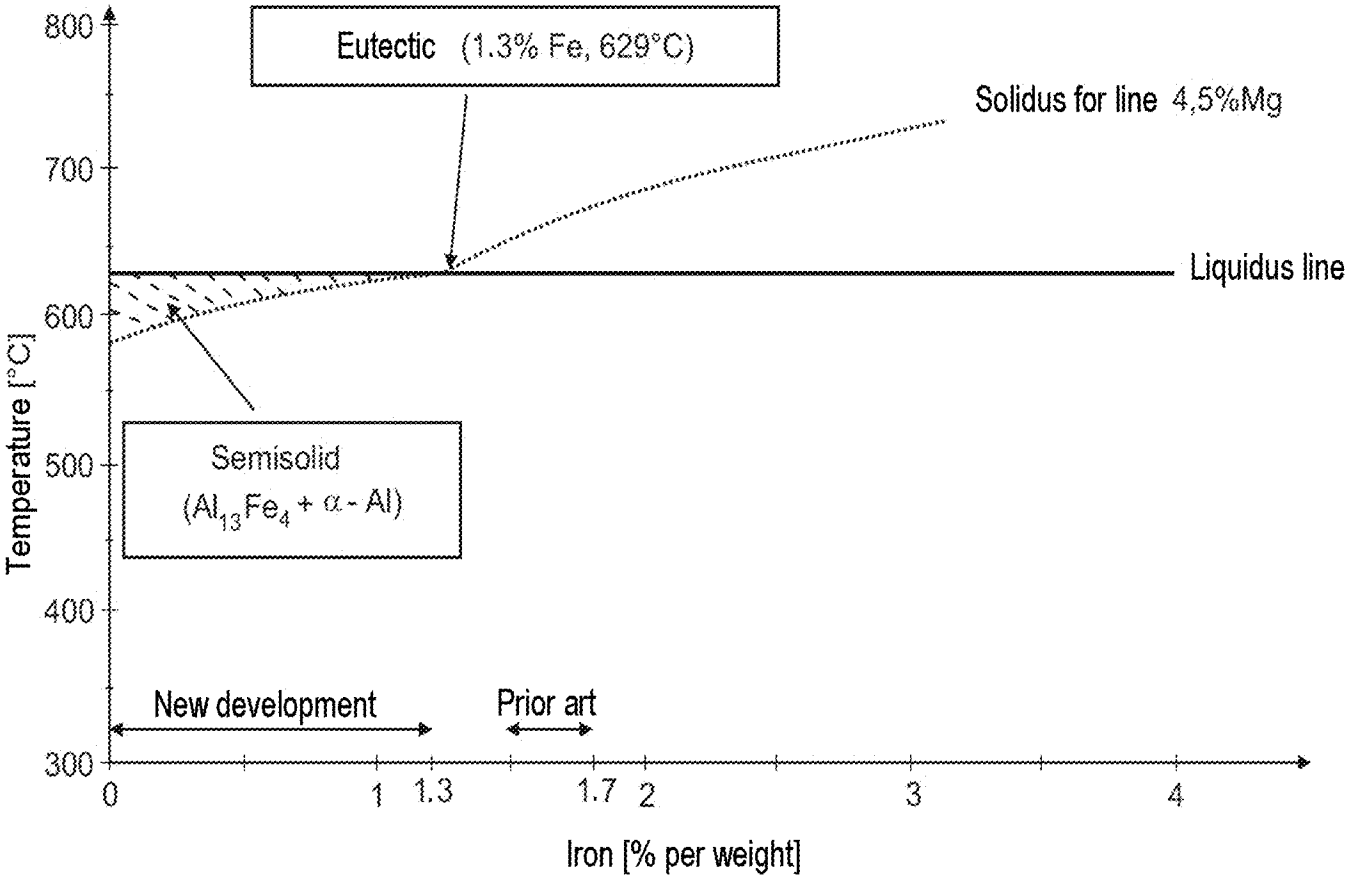
FIG. 3 shows a phase diagram that shows the dependence of various phases on the proportion of iron in an aluminum alloy.

The alloy 20 used in this example has the following components:

Magnesium: 4.3% by weight
Iron: 1.0% by weight
Silicon: 0.1% by weight
Copper: 0.1% by weight
Manganese: 0.075% by weight
Aluminum: remainder The significance of the proportion of iron being less than 1.3% by weight (in this case 1.0% by weight) becomes clear from the phase diagram in FIG. 3, which illustrates the formation of various phases as a function of the proportion of iron. In this case, it can be seen that a mixed phase comprising solid aluminum in a liquid phase can only be achieved if the proportion of iron is restricted as described and is thus below the value of 1.3% by weight for the eutectic. Otherwise, formation of solid Al13Fe4 takes place first, before the pure aluminum phase is formed. This would be the case, for example, with alloys that can be used for diecasting in the prior art, which usually have a proportion of iron between 1.5% by weight and 1.7% by weight. One example of this would be Castaduct®-42, which differs from the alloy used according to the present disclosure, in particular, by having a proportion of iron of 1.6% by weight.

Figure 4:
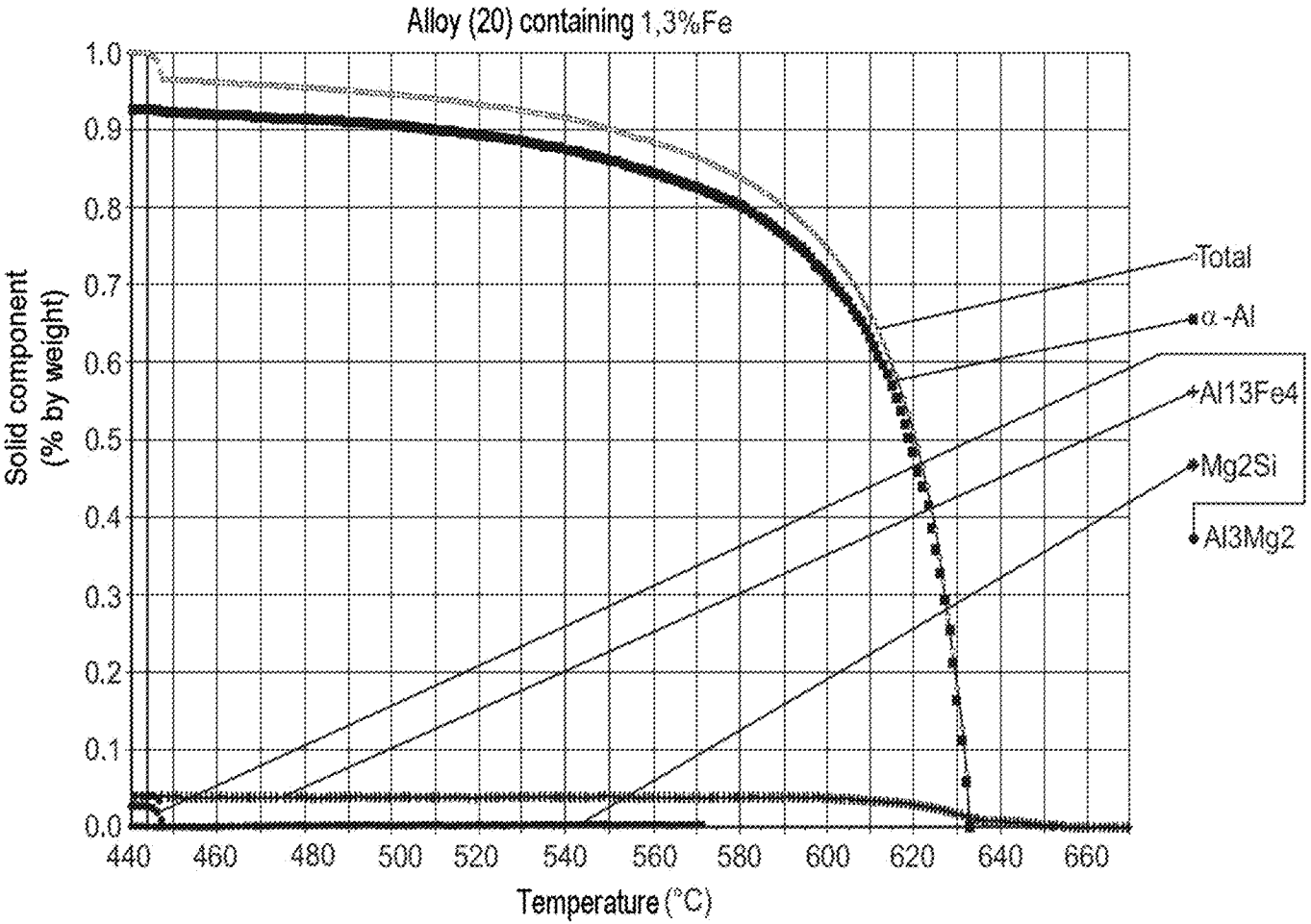
FIG. 4 shows a diagram which illustrates the temperature-dependent formation of individual phases in an aluminum alloy suitable for diecasting.
Figure 5:
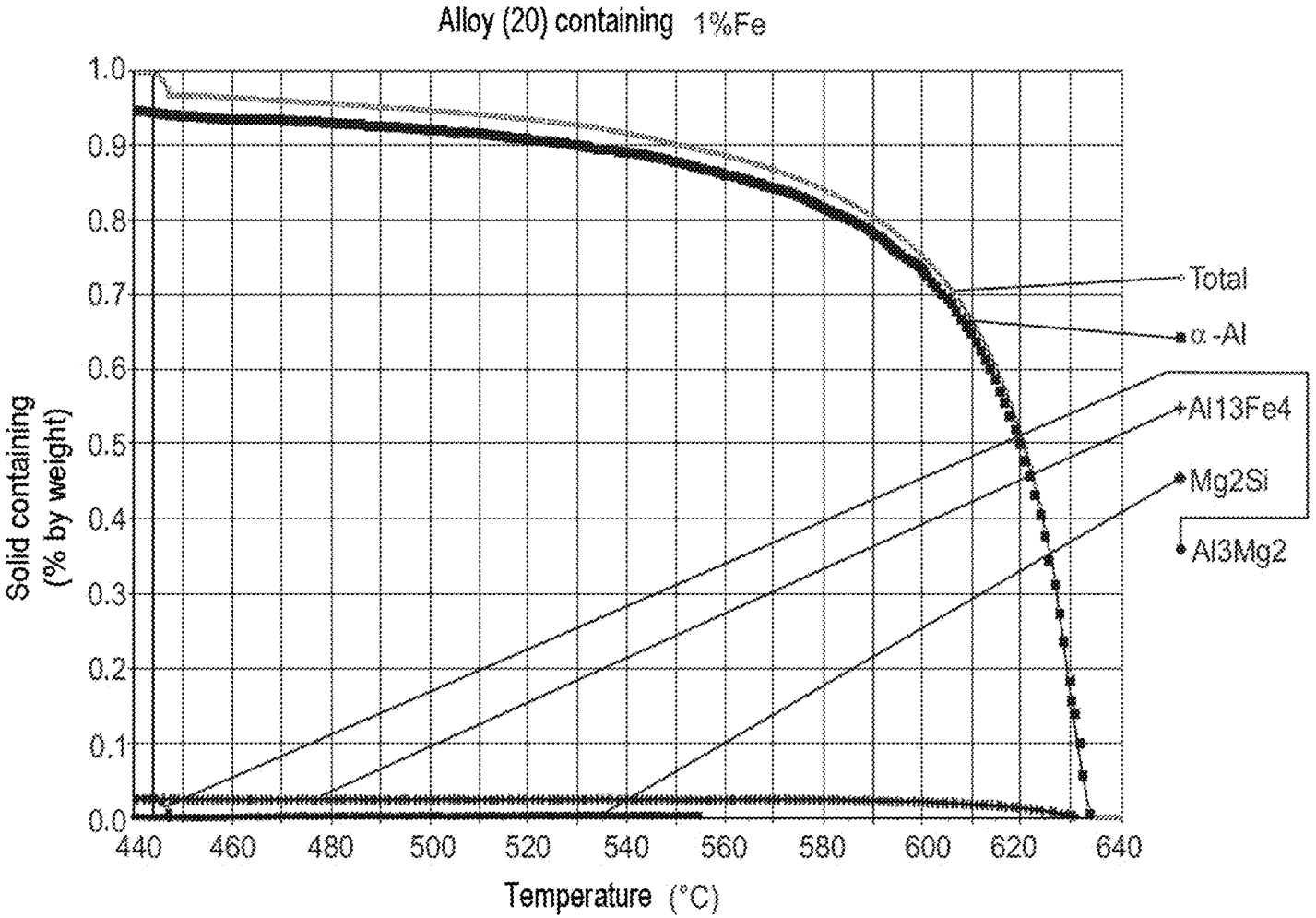
FIG. 5 shows a diagram which illustrates the temperature-dependent formation of individual phases in an aluminum alloy suitable for the method according to the teachings of the present disclosure.

This state of affairs is clear once again from the diagrams in FIGS. 4 and 5, which each illustrate the temperature-dependent formation of individual phases. FIG. 4 shows a corresponding diagram for an alloy that cannot be used according to the teachings of the present disclosure, having the following components:

Magnesium: 4.3% by weight
Iron: 1.3% by weight
Silicon: 0.1% by weight
Copper: 0.1% by weight
Manganese: 0.075% by weight
Aluminum: remainder It can be seen that the formation of Al13Fe4 is already beginning at about 655° C., while the formation of the Al phase begins only below about 633° C. FIG. 5 shows a diagram for the above-described alloy that can be used according to the teachings of the present disclosure. The reduction of the proportion of iron to 1.0% by weight suppresses the formation of the Al13Fe4-phase, with the result that it starts only below about 631° C., while the formation of the Al phase is once again already beginning below about 633° C.

In the case of the alloy according to the present disclosure used here, the proportion of silicon is 0.1% by weight. This proportion can be further reduced without prejudicing the advantageous properties described above, e.g. to 0.05% by weight, 0.01% by weight or 0.001% by weight.

Figure 6C:
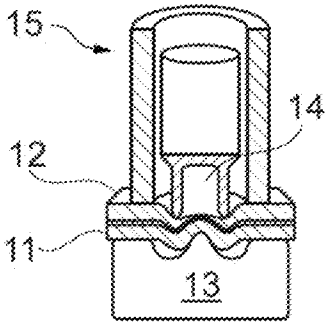
FIGS. 6A-6E show various stages of a joining process using a component produced according to the teachings of the present disclosure.
Figure 6B:
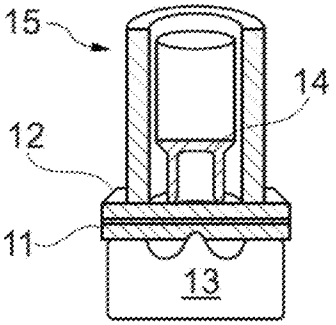
Figure 6E:
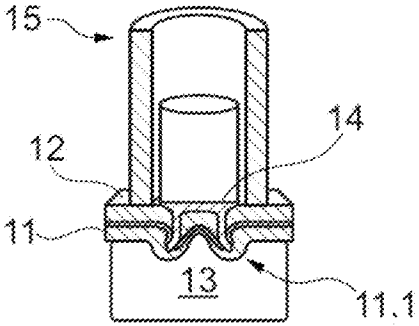
Figure 6A:
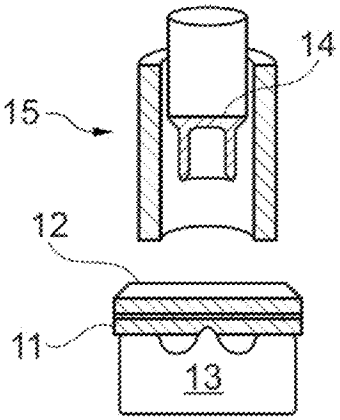
Figure 6D:
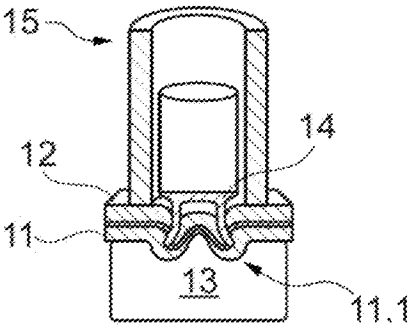

FIGS. 6A-6E show various phases of a method in which a component is produced according to the present disclosure, where an aluminum part 11 is connected to a steel part 12 by self-piercing riveting. Here, both parts 11, 12 are illustrated as flat plates, but this should not be interpreted restrictively. The aluminum part 11 is laid on a die 13, wherein the steel part 12 rests on the component 11. A semi-tubular rivet 14 is accommodated in a setting unit 15 (see FIG. 6A). The setting unit 15 is placed on the steel part 12, thereby fixing the joining location envisaged. At the same time, the semi-tubular rivet 14 is pushed forward and placed in contact (FIG. 6B). By means of a further forward motion, there is first of all a plastic deformation of the steel part 12 and of the aluminum part 11 into the die 13, while the semi-tubular rivet 14 still retains its original shape (FIG. 6C). Subsequently, the semi-tubular rivet 14 punches only through the steel part 12 situated at the top and forms the underlying aluminum part 11 plastically to form a closing head 11.1 (FIGS. 6D and 6E). At the same time, the stem of the semi-tubular rivet 14 is spread apart, thereby completing the positive connection. It is self-evident that a high degree of forming takes place in the region of the closing head 11.1, wherein particularly high ductility is desired to avoid cracks or tears. It has been found that components which have been produced according to the present disclosure have a particularly low tendency to form or do not form cracks in this method.

Apart from the self-piercing riveting process shown here by way of example, the aluminum part 11 can also advantageously be used with other connection methods, among which there are, in particular, screw-joining by flow drilling, high-speed tack setting, friction welding and weld riveting.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method for producing a component, the method comprising:

preparing an alloy based on aluminum and converting the alloy into a semisolid state including solid particles of pure aluminum suspended in a liquid metal, the semisolid state free of solid aluminum-iron particles; and forming the component with a semisolid method, wherein the alloy contains less than 1.3% by weight of iron and no more than 0.2% by weight of silicon.

2. The method according to claim 1, wherein the component is produced by rheocasting by introducing the alloy in the semisolid state into a predominantly closed mold cavity via at least one transfer opening and solidifying the alloy in the mold cavity.

3. The method according to claim 1, wherein the alloy contains no more than 0.05% by weight of silicon.

4. The method according to claim 1, wherein the alloy contains no more than 1.0% by weight of iron.

5. The method according to claim 1, wherein the alloy contains at least 0.1% by weight of iron and no more than 1.0% by weight iron.

6. The method according to claim 1, wherein the alloy contains magnesium.

7. The method according to claim 6, wherein the alloy contains 3.0-4.6% by weight of magnesium.

8. The method according to claim 1, wherein the alloy contains no more than 1.0% by weight of additional elements which differ from aluminum, magnesium, iron and silicon.

9. The method according to claim 1, wherein the alloy contains no more than 0.05% by weight of silicon, at least 0.1% and no more than 1.0% by weight of iron, and 3.0-4.6% by weight of magnesium.

10. The method according to claim 9, wherein the alloy contains about 4.3% by weight of magnesium, about 1.0% by weight of iron, about 0.1% by weight of copper, and about 0.075% by weight of manganese.

11. The method according claim 1, wherein the component is a motor vehicle component.

12. The method according to claim 11, wherein the alloy contains no more than 1.0% by weight of additional elements which differ from aluminum, magnesium, iron and silicon.

13. The method according to claim 1, further comprising heating the alloy to a liquid state having a temperature below 655 degrees Celsius to prevent formation of the solid aluminum-iron particles and then cooling the liquid alloy to convert the liquid alloy to the semisolid state.

14. The method according to claim 1, further comprising heating the alloy to a temperature exceeding 620 degrees Celsius and below 633 degrees Celsius to form the solid aluminum particles suspended in the liquid metal and to prevent formation of solid aluminum-iron particles before formation of the solid aluminum particles.

15. A method for producing a component, the method comprising:

rheocasting an aluminum alloy containing less than 1.3% by weight of iron and no more than 0.2% by weight of silicon and forming the component, the aluminum alloy including solid particles of pure aluminum suspended in a liquid metal and free of solid aluminum-iron particles suspended in the liquid metal.

16. The method according to claim 15, wherein the alloy contains no more than 0.05% by weight of silicon.

17. The method according to claim 15, wherein the alloy contains no more than 1.0% by weight of iron.

18. The method according to claim 15, wherein the alloy contains at least 0.1% by weight of iron and no more than 1.0% by weight iron.

19. The method according to claim 15, wherein the alloy contains no more than 0.05% by weight of silicon, at least 0.1% and no more than 1.0% by weight of iron, and 3.0-4.6% by weight of magnesium.

20. The method according to claim 19, wherein the alloy contains about 4.3% by weight of magnesium, about 1.0% by weight of iron, about 0.1% by weight of copper, and about 0.075% by weight of manganese.

* * * * *